US005680732A

United States Patent [19]

Skouras

[11] Patent Number: 5,680,732

[45] Date of Patent: Oct. 28, 1997

[54] LIFTING AND SHORING JACK ASSEMBLY

[76] Inventor: Joseph Alexander Skouras, R.R. #3, Site 7, Box 25, North Bay, Ontario, Canada, P1B 8G4

[21] Appl. No.: 663,102

[22] PCT Filed: Dec. 23, 1994

[86] PCT No.: PCT/CA94/00709

§ 371 Date: Jun. 28, 1996

§ 102(e) Date: Jun. 28, 1996

[87] PCT Pub. No.: WO95/18280

PCT Pub. Date: Jul. 6, 1995

[30] Foreign Application Priority Data

Dec. 31, 1993 [CA] Canada ..... 2112722

[51] Int. Cl.[6] ..... E04G 1/20; E04B 2/82

[52] U.S. Cl. ..... 52/126.1; 52/123.1; 52/114; 52/117

[58] Field of Search ..... 52/122.1, 123.1, 52/126.1, 127.1, 114, 116, 117, 119, 120; 248/354.1, 354.3

[56] References Cited

U.S. PATENT DOCUMENTS 5,271,596 12/1993 Holcomb et al. ..... 249/354.3

FOREIGN PATENT DOCUMENTS 405209457 8/1993 Japan ..... 52/126.1

*Primary Examiner*—Robert Canfield
*Assistant Examiner*—Yvonne Horton-Richardson
*Attorney, Agent, or Firm*—Jacobson, Price, Holman & Stern, PLLC

[57] ABSTRACT

A lifting and shoring jack assembly includes a main support assembly having a main column, a jack screw slidably mounted within the main column, and a jack nut engaged with the jack screw and bearing on the end of the main column. A load plate mounted at the free end of the jack screw facilitates engagement of the jack assembly with a load to be supported. Extensible side braces are pivotally mounted on the main column, and also include load engaging plates for load-bearing attachment to the load to be supported.

6 Claims, 6 Drawing Sheets

LIFTING AND SHORING JACK ASSEMBLY

FIELD OF THE INVENTION

This invention relates to load bearing support columns, and in particular to an adjustable lifting and shoring jack assembly.

BACKGROUND TO THE INVENTION

Adjustable support posts or columns are well known in the art. Typically, conventional support columns, such as lifting jacks for lifting and supporting of various structures employ a single, threaded support rod disposed in a main column. Many of these assemblies comprise a main column composed of two or more telescoping elements which can be extended and locked at predetermined intervals, such that the column can be adjusted to a length which is slightly shorter than that which is actually required. The threaded support rod, which may either engage an internal screw in the main column or an adjusting nut which bears on the top of the column, is then extended as required to support and/or raise the structure in question.

For example, U.S. Pat. No. 3,027,140 (Holzbach) discloses an adjustable element which is adapted to be quickly and removably fitted to a fixed length column. The disclosed adjustable element comprises an adjusting screw and nut, a bearing plate, and a base plate. The adjustable element is intended to be used in conjunction with a column or post which is obtained separately, and cut approximately to length, by the user, on site.

However, in some cases it is necessary to raise the structure by a substantial distance. For example, when a house or other structure is jacked to permit moving of same, or to raise its foundation, it is frequently found to be necessary to raise the structure by one meter or more. However, conventional jack posts of the type disclosed in U.S. Pat. No. 3,027,140 tend to become unstable, and prone to buckling, due to the extreme length of the adjusting screw extending from the fixed length column portion.

U.S. Pat. No. 4,872,634 (Gillaspy et al) discloses a brace assembly which consists of a main brace and a pair of side braces pivotally attached thereto. The length of the main brace is adjustable by means of threaded couplings mounted on the ends thereof. Each of the threaded couplings consists of a length of threaded rod slidably fitted within the hollow main brace, and a nut which bears against an end surface of the main brace. A mounting bracket is pivotally fitted to the free end of each of the side braces to permit the side braces to be attached to a portion of a member being supported (i.e. a wall), or to some other structure (such as a floor), so as to lend stability to the main brace.

However, since the side braces are of fixed length, the extent to which the main brace can be extended after the side braces have been attached is severely limited. Accordingly, a supporting system such as that disclosed in U.S. Pat. No. 4,872,634 is of limited use in situations where a structure being supported must be lifted through a substantial distance.

Finally, when used to support a structure of substantial weight, a jack post tends to be forced downwards into the earth. Typically, the base plates provided on conventional jack posts do not distribute the weight over sufficient surface area to prevent from undue sinking of the post into soft and/or unprepared earth. Thus the safe and effective use of conventional jack posts is often impossible under these conditions.

SUMMARY OF THE INVENTION

It is therefore an object of the present invention to provide an adjustable lifting and shoring jack assembly capable of lifting a load through a substantial distance, and which can be safely and effectively used on soft and/or unprepared earth.

According to an aspect of the present invention, there is provided a lifting and shoring jack assembly comprising: baseplate means, said baseplate means being capable of distributing load forces over a sufficiently large surface area to substantially prevent said jack assembly from sinking into soft earth when subjected to a load; support column means removably disposed on said baseplate means; jack screw means slidably disposed within said support column means and at least partially extending therefrom; jack nut means operatively engaged with said screw means, and bearing on an end surface of said support column means; load plate means disposed on a free end of said screw means and capable of load bearing engagement with a load to be supported; and at least two side brace means pivotally connected to said column means, each of said side brace means comprising: a respective elongate brace arm pivotally connected at an end thereof to said support column means; respective length adjusting means disposed at a free end of each of said brace arms for adjusting the length of each of said brace arms; and respective load engaging means pivotally disposed on said respective adjusting means to facilitate load bearing engagement between the load to be supported and each of said side brace means.

In a preferred embodiment, the column means is removable from the base plate means, thereby permitting the assembly to be disassembled for ease of storage and transportation.

In a further preferred embodiment, the lifting and shoring jack assembly is further provided with a second supporting column comprising secondary support column means removably disposed on said baseplate means; extension screw means slidably disposed within said secondary support column means and at least partially extending therefrom; extension nut means operatively engaged with said extension screw means, and bearing on an end surface of said secondary support column means; and jack means disposed on a free end of said screw means and capable of load bearing engagement with a load to be supported.

Preferably, the jack means is a hydraulic jack.

BRIEF DESCRIPTION OF THE DRAWINGS

Further objects, features and advantages of the invention will become apparent from the following description of a preferred embodiment when read in conjunction with the accompanying drawings, in which.

FIG. *6a* is a perspective view illustrating a third embodiment of the present invention.

It should be noted that throughout the figures, like elements are identified by like reference numerals.

DETAILED DESCRIPTION OF PREFERRED EMBODIMENTS

Figure 1:
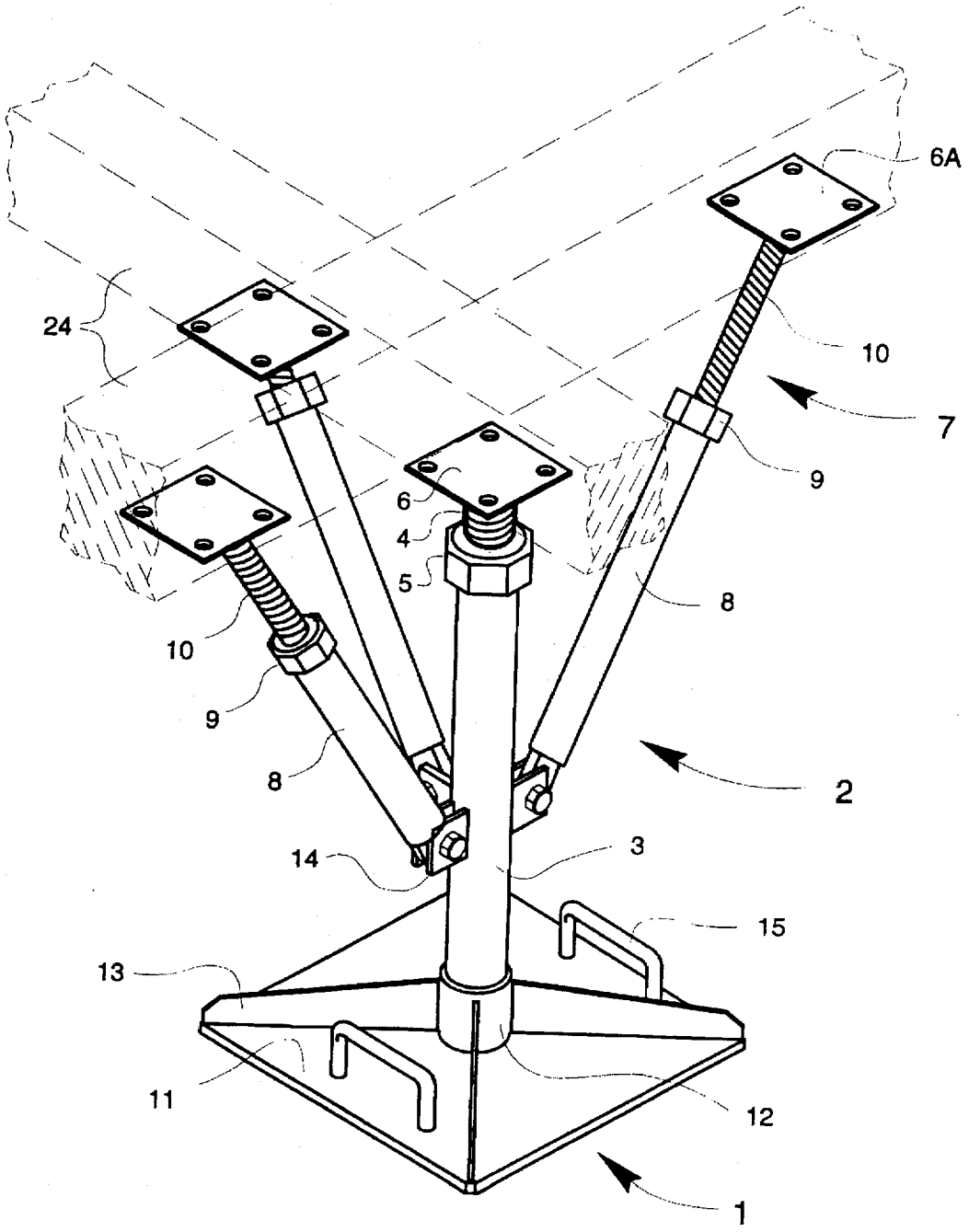
FIG. 1 is a perspective view illustrating a first embodiment of the present invention.
Figure 2:
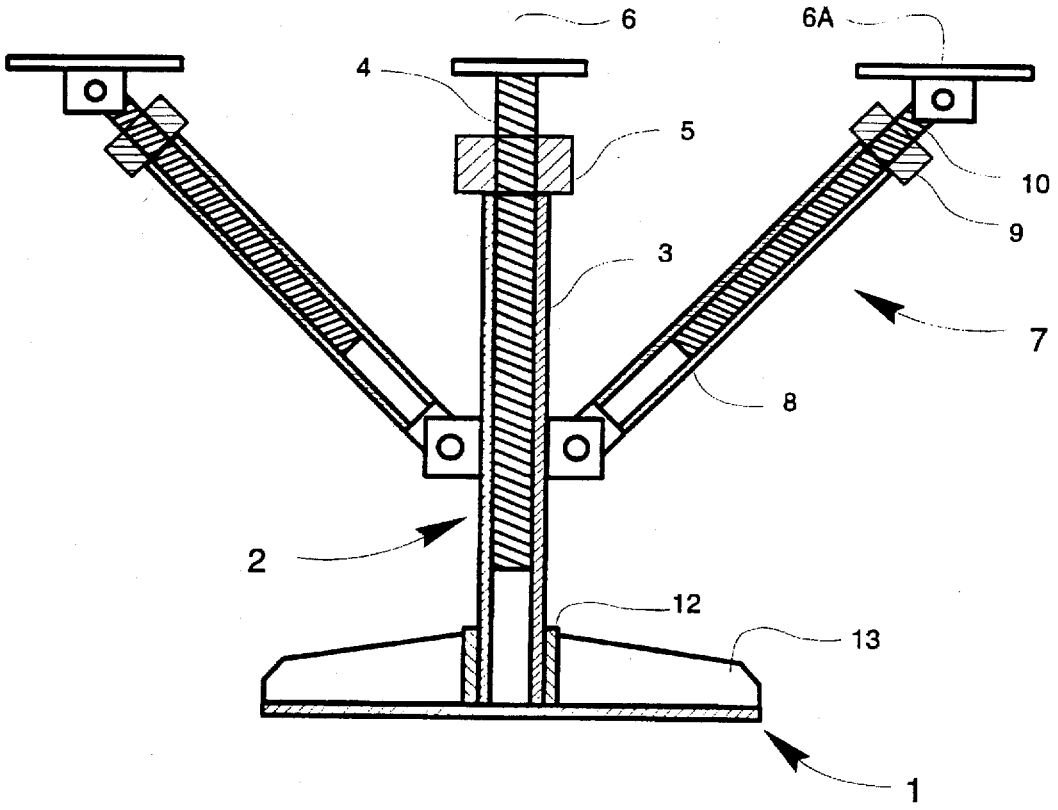
FIG. 2 is a side view showing the embodiment of FIG. 1 in cross-section.

Referring to FIGS. 1 and 2, the jack assembly comprises a baseplate 1, and a main support assembly 2. The main support assembly 2 comprises a hollow main column 3 mounted on the baseplate 1, a jack screw 4 slidably disposed within the main column 3 and at least partially extending therefrom, a jack nut 5 in threaded engagement with the jack screw 4, and bearing on the end surface of the main column 3, and a load plate 6 mounted on the exposed free end of the jack screw 4. At least two side braces 7 (three are illustrated in FIG. 1) are pivotally mounted on the main column 3. Each of the side braces 7 is designed to be adjustable in length as the load to be supported (diagrammatical represented in FIG. 1 by beams 24) is raised by the main support assembly 2, and include a respective load plate 6*a* which facilitates engagement with the load to be supported. Conveniently, the side braces 7 can have a construction similar to that of the main support assembly 2, in that they can comprise a hollow brace arm 8 pivotally connected to the main column 3, a length of threaded rod 9 slidably mounted within the brace arm 8, and an adjusting nut 10 in threaded engagement with the threaded rod and bearing on the end surface of the brace arm 8.

The baseplate can have any desired configuration, provided that it offers a large "footprint", so that heavy loads can be securely supported by the jack assembly, even when used on soft and/or unprepared earth. Conveniently, the baseplate 1 will consist of a generally square or rectangular bottom plate 11, a centrally-located column seat 12 for receiving the main column 3, and a set of generally radially oriented stiffening ribs 13 for transferring load forces outward towards the periphery of the bottom plate 11. The bottom plate and stiffening ribs 13 can conveniently be constructed of steel plate, and the column seat 12 from hollow round structural steel, the entire baseplate 1 being fastened together by, for example, welding. A lifting handle 15 is located on each side of the bottom plate 11.

The interior diameter of the column seat 12 is suitably sized with respect to the outside diameter of the main column 3, so that the main column 3 is held securely therein during use of the jack assembly, but can be readily removed therefrom for ease of transportation. However, the main column 3 can be permanently fastened in the column seat 12, for example by means of welding, in cases where disassembly for ease of transportation is not a consideration.

The main column 3 is conveniently constructed of hollow tubular steel, and will be sized appropriately according to the loads to be supported. Similarly, the jack screw 4 and jack nut 5 will be suitably sized according to the load to be supported. In addition, the outer diameter of the jack screw 4 will be selected to provide a clear sliding fit within the main column 3. However, the fit between the jack screw 4 and the interior of the main column 3 must be close enough to substantially prevent an angular offset between the main column 3 and the jack screw 4 (with the attendant increased bending stresses and risk of buckling). The length of the jack screw 4 will be selected according to the desired distance through which the load is to be lifted, but can conveniently be approximately the same length as that of the main column 3, thereby allowing jack assembly to lift the load to be supported through a distance as close as possible to the height of the main column 3.

Each of the side braces 7 is pivotally attached to the main column 3 by means of respective pins or bolts and support lugs 14 attached to the exterior of the main column 3 (for example by means of welding) so as to not interfere with movement of the jack screw within the main column 3.

Figure 4:
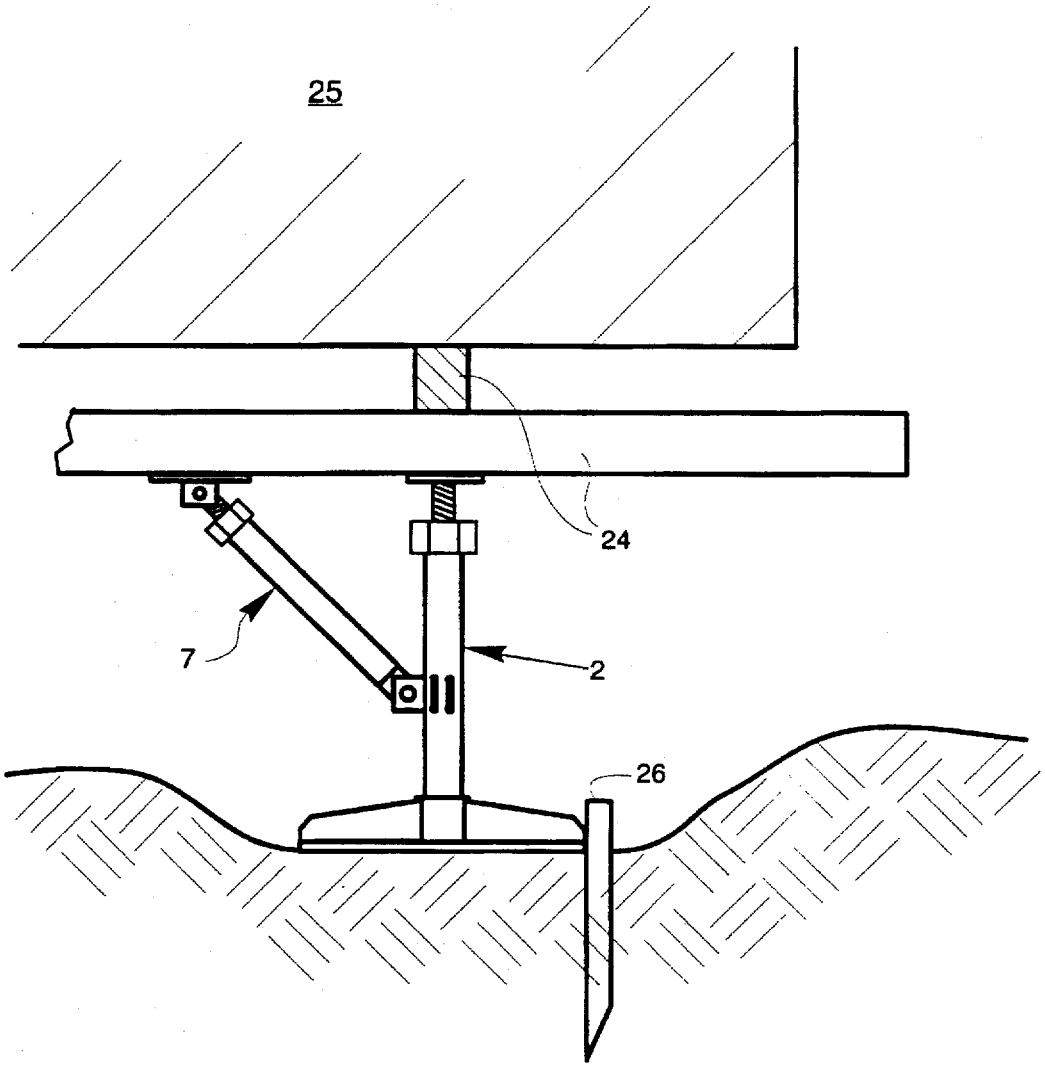
FIG. 4 is an elevation view illustrating an embodiment of the present invention in use for supporting and raising a building.

In use, the jack assembly is located under a load to be supported (see FIG. 4), and the load plates 6 and 6*a* of the main support assembly 2 and side braces 7, respectively, are attached to the load to be supported, such as a building 25 and/or temporary support beams 24 located under the building 25 to facilitate the jacking thereof (note that in FIG. 4, only one side brace 7 is shown for clarity.). If desired, the base plate 1 can be secured against lateral (sliding) movement by the use of stakes 26 driven into the ground. The jack screw is then turned in a direction to extend the jack screw 4, from the main column 3, so as to raise the load to be supported, through a desired distance. As the load to be supported is raised by the main support assembly 2, the threaded rods 10 of the side braces 7 are pulled outwards from their respective brace arms 8. As this occurs, the adjusting nuts 9 are turned in order to maintain each of the side braces in compression, so that at least some of the weight of the load being supported is transferred to the main column 3 through the side braces 7. The maintenance of a compressive loading in each of the side braces 7 serves two purposes. First, it reduces the load forces acting on the jack screw 4 and jack nut 5, thereby making the jack nut 5 easier to turn. Second, the forces exerted by the side braces on the main column 3 tend to brace the main column 3 against bucking, thereby increasing the effective load carrying capacity of the jack assembly of the invention.

Figure 3:
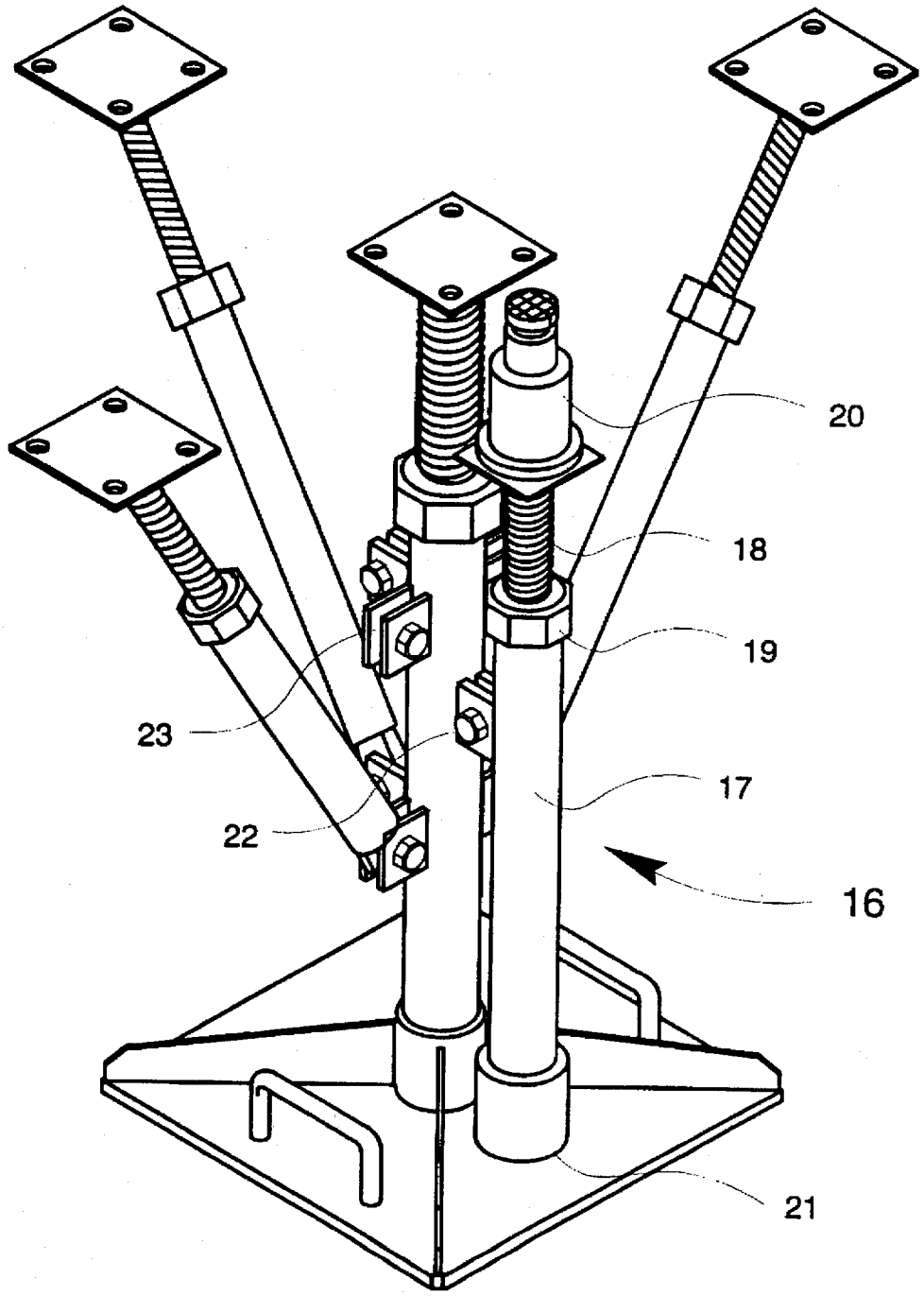
FIG. 3 is a perspective view illustrating a second embodiment of the present invention.

FIG. 3 illustrates a second embodiment of the jack assembly of the present invention. This second embodiment retains the base plate 1, main support assembly 2, and side braces 7 described in respect of the first embodiment. Accordingly, these elements will not be further discussed in detail. The lifting and shoring jack assembly, according to the second embodiment of the invention, is provided with a secondary support assembly 16 comprising a secondary support column 17 mounted on the baseplate 1; an extension screw 18 slidably disposed within the secondary support column 17 and at least partially extending therefrom; an extension nut 19 engaged with the extension screw 18 and bearing on an end surface of the secondary support column 17; and a lifting jack 20 mounted at the top of the extension screw 18.

The secondary support column 17 is preferably mounted on the baseplate 1, by means of a secondary support column seat 21 in essentially the same manner as the main column 3. In addition, the secondary support column 17 is removably coupled to the main column 3, at least during use, by means of a bolt (or the like) and lugs 22 affixed near the top of secondary support column 17 and the main column 3.

The operation of the jack assembly according to the second embodiment of the invention is essentially the same as that of the first embodiment, except that in this case, the lifting jack 20 (which preferably comprises a conventional hydraulic or pneumatic jack) is used to lift the load being supported through a small distance; the jack nut 5, and adjusting nuts 9 are then tightened so that the main support assembly 2 and side braces 7 carry the weight of the load being supported; the lifting jack 20 is thereby released so that the extension nut 19 can be turned to extend the extension screw 18, thereby raising the lifting jack 20 without lifting the load being carried. By this means, the load being supported can be raised through a series of comparatively small incremental steps, thereby ensuring safe operation of the jack assembly.

As a further safety measure, additional side support lugs 23 can be provided near the top of the main column 3. These additional lugs permit a further set of side braces 7 to be mounted on the main column 3, thereby increasing the buckling resistance of the main support assembly 2. In addition, the baseplate 1 can be modified as desired to provide additional reinforcement to the central portion of the bottom plate 11, particularly under the main support assembly 2 and the secondary support assembly 16.

Figure 5:
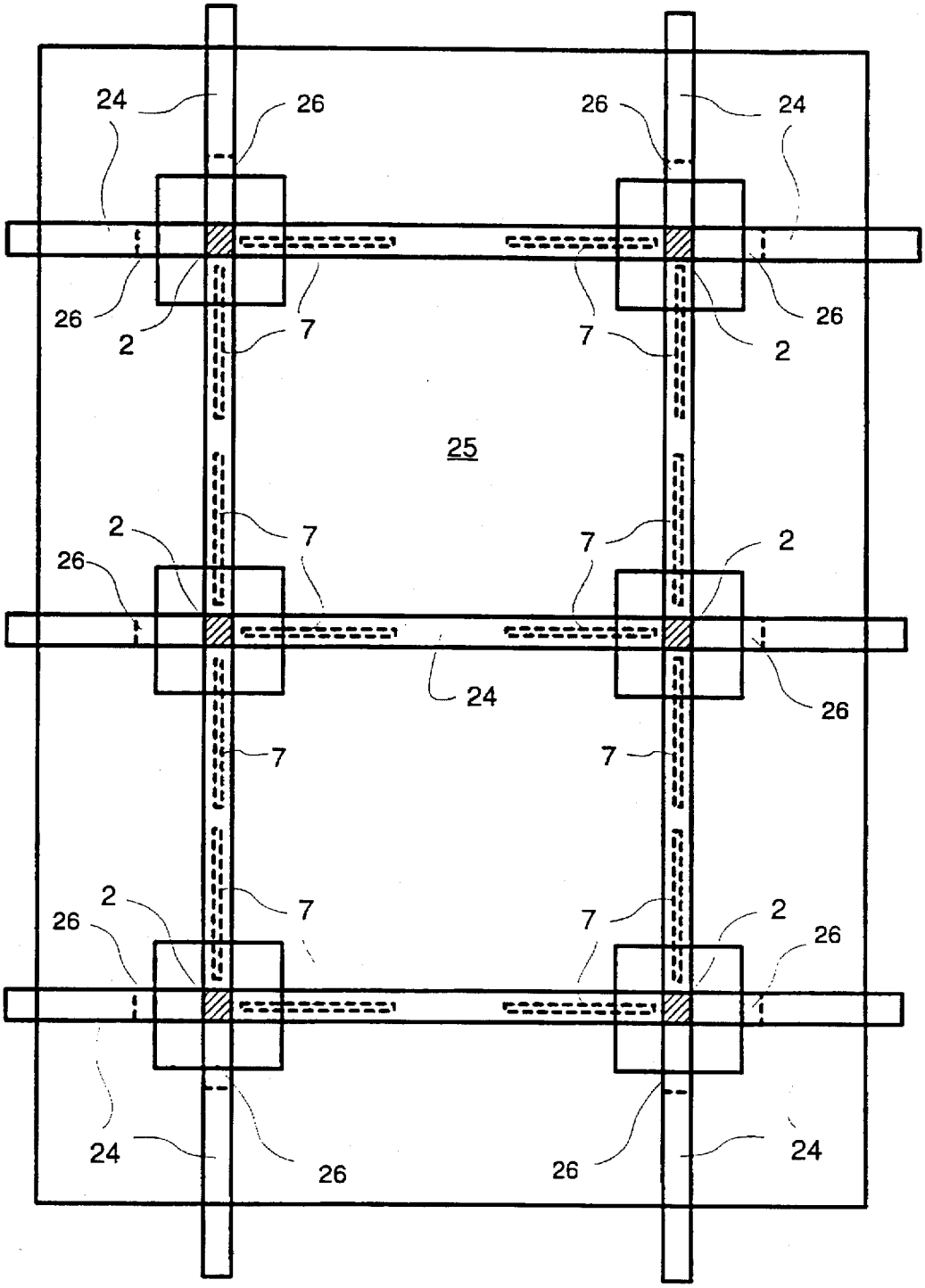
FIG. 5 is a plan view illustrating the placement of several jack assemblies according to the invention in relation to a building being supported and raised.

FIGS. 4 and 5 illustrate the use of the jack assembly according to the present invention for supporting and raising a building 25. FIG. 4 presents an elevation view of a jack assembly being used, while FIG. 5 presents a plan view showing the general locations of each of the jack assemblies used, along with supplementary supporting beams or timbers 24 and bracing stakes 26 in relation to the building 25 being supported and lifted.

In order to ensure adequate support of the building 25, while it is being lifted, a set of lateral and longitudinal support beams (or timbers) 24 are preferably provided under the building 25. A number of jack assemblies (in the present example, six are employed) are then installed such that the main support assemblies 2 thereof are positioned under the respective intersection points of the beams 24. At this point, side braces 7 are mounted on each of the respective main support columns 3, and attached to the beams 24, generally as illustrated in FIGS. 1, 4 and 5. Following the installation of the beams 24 and jack assemblies, in this manner, the building 25 can be raised by operating each of the jack assemblies in the manner described above in connections with FIGS. 1–3. In tests performed by the inventor, two houses (one measuring approximately 30' by 40') were successfully raised by this method. During one of these tests, the house in question was subjected to winds in excess of 100 km/hr without ill effect.

Figure 6A:
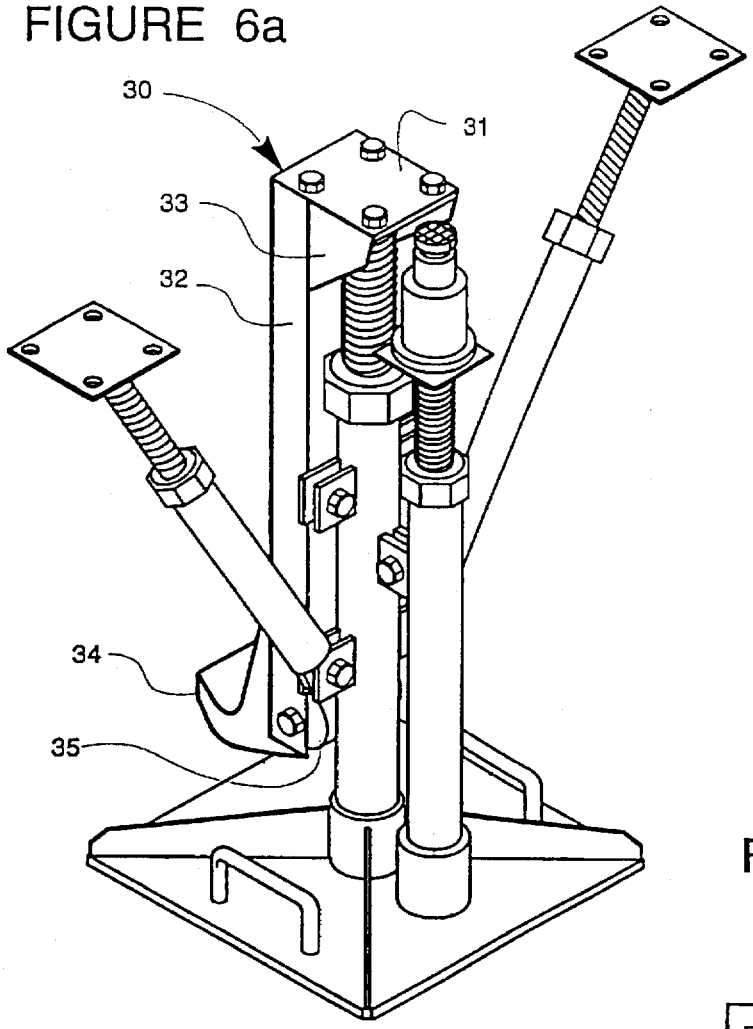
FIGS. 6*b* and 6*c* are partial cross-sectional views through the main column of the embodiment of FIG. 6*a*.

FIG. 6*a* is a perspective view illustrating a third embodiment of the present invention. This third embodiment can be considered as a modification of the embodiment of the invention described above in connection with FIG. 3. In this case, however, only two side braces 7 are pivotally attached to the main column 3 by means of respective pins or bolts and support lugs 14 attached to the exterior of the main column 3. A hook assembly 30 is mounted on the main support assembly 2, opposite the secondary support assembly 16, and is designed to engage (and lift) a load disposed near the ground.

The hook assembly 30 comprises a pressure plate 31 capable of being bolted to the load plate 6 of the main support assembly 2. A suspender 32 is affixed to the pressure plate 31, for example by means of welding. In addition, reinforcing plates 33 can be provided to reinforce the pressure plate and strengthen the connection between the pressure plate 31 and the suspender 32. At the base of the suspender 32, a lifting hook 34 is provided for engaging a load. The length of the suspender 32 is preferably determined so that, when the main support assembly 2 is lowered to it greatest extent, the lifting hook 34 is capable of being operatively positioned beneath a load which is close (for example, less than approximately 200 mm) to the ground.

Figure 6B:
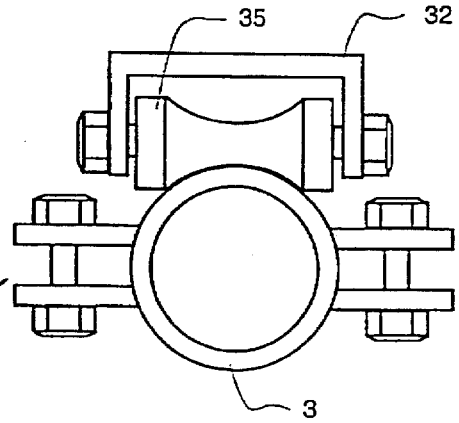
Figure 6C:
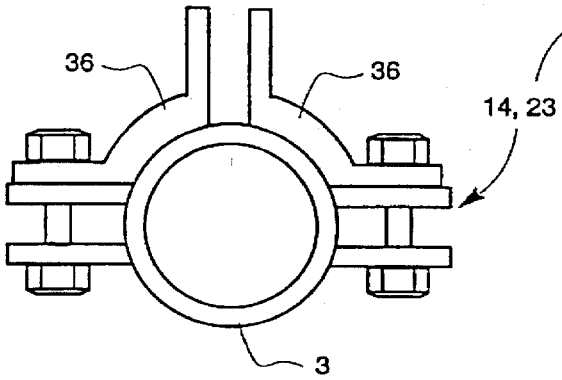

In order to brace the lifting hook 34 against undesired movement, a roller 35 is conveniently mounted on the suspender 32, preferably in the vicinity of the lifting hook 34, so as to bear against the main column 3. Preferably, the roller is provided with an hour-glass profile, as illustrated in FIG. 6*b*, which allows the roller 35 to operatively engage the side of the main column 3 in such a manner as to resist lateral (i.e. side-to-side) motion of the lifting hook 34. In order to permit the roller 35 an unobstructed path along the length of the main column 3, no lugs 14, 23 (see FIG. 3) are provided for the installation of side braces 7 on that side of the main column 3. However, if it is desired to remove the hook assembly 30, mounting brackets 36 can be installed as illustrated in FIG. 6*c*. The mounting brackets 36 are conveniently designed to be supported on the lugs 14, 23 welded on opposite sides of the main column 3. By means of the mounting brackets 36, a third side brace 7 can be mounted on the main column 3, and the jacking assembly used in the same manner as the embodiment illustrated in FIG. 3.

It will be appreciated that, while the present invention has been described in connection with three of its embodiments, it is by no means limited to same, but may instead by varied within the scope of the appended claims.

INDUSTRIAL APPLICABILITY

As will be clear from the forgoing description, the present invention can be used singly or in combination to support and lift heavy loads, and is particularly suited to lifting heavy loads while standing on uneven or unprepared soil. As such, in addition to the specific application described in detail above, the present invention is applicable (but is by no means limited) to such diverse areas as emergency supports (e.g. in an earthquake disaster area), lifting heavy equipment (e.g. construction equipment) for carrying out hard-to-reach maintenance or repair work, and in mining industries.

I claim:

1. A lifting and shoring jack assembly comprising:

baseplate means, said baseplate means being capable of distributing load forces over a sufficiently large surface area to substantially prevent said jack assembly from sinking into soft earth when subjected to a load;

support column means removably disposed on said baseplate means;

jack screw means slidably disposed within said support column means and at least partially extending from an upper end thereof;

jack nut means operatively engaged with said screw means, and bearing on an upper end surface of said support column means;

load plate means disposed on a free end of said screw means and capable of load bearing engagement with a load to be supported; and at least two side brace means pivotally connected to said column means at a point located between said baseplate means and said jack screw means, each of said side brace means comprising:

a respective elongate brace arm pivotally connected at an end thereof to said support column means;

respective length adjusting means disposed at a free end of each of said brace arms for adjusting the length of each of said brace arms; and respective load engaging means pivotally disposed on said respective adjusting means to facilitate load bearing engagement between the load to be supported and each of said side brace means.

2. An assembly as claimed in claim 1, wherein said adjusting means comprises a threaded rod slidably disposed in said brace arm and at least partially extending therefrom, and an adjusting nut means operatively engaged with said threaded rod, and bearing oh an end surface of said elongate brace arm.

3. An assembly as claimed in claim 1, further comprising a secondary support means removably disposed on said baseplate means, and substantially parallel to said support column means, said secondary support means comprising:

secondary support column means removably disposed on said baseplate means;

extension screw means slidably disposed within said secondary support column means and at least partially extending from an upper end thereof;

extension nut means operatively engaged with said extension screw means, and bearing on an upper end surface of said secondary support column means; and jack means disposed on a free end of said extension screw means and capable of load bearing engagement with a load to be supported;

whereby during lifting of a load, said jack means of said secondary support means is deployed to lift the load through a small distance, the main jack assembly and the side brace means are adjusted to assume the load in the raised position, and the sequence of operations is repeated to progressively raise the load by a series of small increments.

4. An assembly as claimed in claim 3, wherein said secondary support means comprises:

secondary support column means removably disposed on said baseplate means;

extension screw means slidably disposed within said secondary support column means and at least partially extending therefrom;

extension nut means operatively engaged with said extension screw means, and bearing on an end surface of said secondary support column means; and jack means disposed on a free end of said screw means and capable of load bearing engagement with a load to be supported.

5. An assembly as claimed in claim 1, wherein said jack means is a hydraulic jack.

6. An assembly as claimed in claim 3, further comprising a hook assembly opposite the secondary support means, said hook assembly including a suspender portion which is mounted at one end on the load plate means of said support column means and which terminates at the other end in hook means, to facilitate the engagement and lifting of a load disposed near a ground surface.

* * * * *